US008601759B2

(12) United States Patent
Bucheger

(10) Patent No.: US 8,601,759 B2
(45) **Date of Patent: *Dec. 10, 2013**

(54) WALL SYSTEM

(76) Inventor: Larry Bucheger, San Diego, CA (US)

( * ) Notice: Subject to any disclaimer, the term of this patent is extended or adjusted under 35 U.S.C. 154(b) by 1 day.

This patent is subject to a terminal disclaimer.

(21) Appl. No.: 13/473,428

(22) Filed: May 16, 2012

(65) Prior Publication Data

US 2012/0222374 A1 Sep. 6, 2012

Related U.S. Application Data

(60) Continuation of application No. 13/051,224, filed on Mar. 18, 2011, now Pat. No. 8,201,379, which is a division of application No. 12/143,063, filed on Jun. 20, 2008, now Pat. No. 8,061,095.

(51) Int. Cl.
*E04B 1/06* (2006.01)

(52) U.S. Cl.
USPC ..... 52/223.7; 52/293.2; 52/293.3; 52/604; 52/607

(58) Field of Classification Search
USPC ..... 52/223.7, 293.2, 293.3, 294, 295, 600, 52/601, 603–607
See application file for complete search history.

(56) References Cited

U.S. PATENT DOCUMENTS

| | | | | |
|---|---|---|---|---|
| 2,141,397 | A | | 12/1938 | Locke |
| 3,112,578 | A | | 12/1963 | Rosenfield |
| 3,382,632 | A | | 5/1968 | Grofcsik |
| 3,390,905 | A | | 7/1968 | Arnott |
| 3,440,334 | A | * | 4/1969 | Blomstrand ..... 174/87 |
| 3,511,000 | A | | 5/1970 | Keuls |
| 3,618,279 | A | | 11/1971 | Sease |
| 3,675,385 | A | | 7/1972 | Chan |
| 3,907,447 | A | | 9/1975 | Arkharov et al. |
| 4,031,678 | A | | 6/1977 | Schuring |
| 4,143,986 | A | * | 3/1979 | Antosh ..... 403/307 |
| 4,372,091 | A | | 2/1983 | Brown et al. |
| 4,757,656 | A | | 7/1988 | Powers, Jr. |
| 4,936,062 | A | | 6/1990 | Golston et al. |
| 5,152,118 | A | * | 10/1992 | Lancelot ..... 52/848 |
| 5,365,715 | A | | 11/1994 | Steinmetz et al. |
| 5,465,538 | A | * | 11/1995 | Powers, Jr. ..... 52/204.2 |
| 5,647,185 | A | | 7/1997 | Forlini |
| 5,678,373 | A | | 10/1997 | Franklin et al. |
| 5,761,855 | A | | 6/1998 | Uang |
| 5,878,544 | A | | 3/1999 | McKinnon |
| 6,098,357 | A | | 8/2000 | Franklin et al. |

(Continued)

*Primary Examiner* — William Gilbert
*Assistant Examiner* — Alp Akbasli
(74) *Attorney, Agent, or Firm* — Stetina Brunda Garred & Brucker

(57) ABSTRACT

The present invention is directed to a block building system for building a wall structure that includes a plurality of preformed blocks configured to be stacked vertically upon one another to form the wall structure. Each block has at least one frustum-shaped protrusion on a top surface of the block, a horizontal channel formed in a bottom surface of the block, and at least one aperture extending vertically through an interior of the block. The system also has at least one base track, a plurality of T-shaped reinforcement members configured to engage with and extend upwardly from the track, a plurality of extension members that interlock with and extend T-shaped reinforcement members, and securing members. One or more courses of blocks can be vertically stacked over the base track by passing the T-shaped reinforcement members and/or extension members through the apertures formed in the blocks, thereby forming the wall structure.

18 Claims, 6 Drawing Sheets

(56) References Cited

U.S. PATENT DOCUMENTS

| | | | | |
|---|---|---|---|---|
| 6,134,853 | A | 10/2000 | Haener | |
| 6,138,426 | A | 10/2000 | Mork et al. | |
| 6,176,061 | B1 * | 1/2001 | Smith | 52/719 |
| 6,202,381 | B1 | 3/2001 | Dame et al. | |
| 6,256,960 | B1 | 7/2001 | Babcock et al. | |
| 6,560,938 | B1 * | 5/2003 | Powers, Jr. | 52/204.2 |
| 6,585,028 | B2 | 7/2003 | Verdicchio | |
| D484,784 | S * | 1/2004 | Siragusa | D8/396 |
| 6,758,020 | B2 | 7/2004 | Cerrato | |
| 6,769,220 | B2 | 8/2004 | Friesner | |
| 6,898,911 | B2 * | 5/2005 | Kornfalt et al. | 52/395 |
| 7,461,487 | B2 * | 12/2008 | Greenberg et al. | 52/293.2 |
| 7,484,339 | B2 * | 2/2009 | Fiehler | 52/742.14 |
| 7,617,642 | B2 | 11/2009 | Espinosa | |
| 7,637,072 | B2 * | 12/2009 | Parish | 52/742.1 |
| 7,712,281 | B2 | 5/2010 | Bott | |
| 7,762,033 | B2 | 7/2010 | Scott et al. | |
| 2004/0025459 | A1 * | 2/2004 | Huebner et al. | 52/282.1 |
| 2004/0074198 | A1 * | 4/2004 | Saldana | 52/712 |
| 2004/0177573 | A1 * | 9/2004 | Newhouse et al. | 52/239 |
| 2004/0211127 | A1 * | 10/2004 | Wiechecki et al. | 52/36.1 |
| 2005/0178081 | A1 * | 8/2005 | Bott | 52/596 |
| 2006/0010827 | A1 | 1/2006 | Vanhoutte | |
| 2007/0056235 | A1 | 3/2007 | Kohler | |
| 2007/0079566 | A1 | 4/2007 | Neill et al. | |
| 2008/0263983 | A1 * | 10/2008 | Stanchfield et al. | 52/459 |
| 2009/0071095 | A1 | 3/2009 | Buchwald | |
| 2009/0217610 | A1 | 9/2009 | Curtis | |
| 2010/0236179 | A1 | 9/2010 | Kim et al. | |

* cited by examiner

WALL SYSTEM

CROSS-REFERENCE TO RELATED APPLICATIONS

The present application is a continuation application of U.S. patent application Ser. No. 13/051,224, filed Mar. 18, 2011 now U.S. Pat. No. 8,201,379 which is a divisional patent application of U.S. patent application Ser. No. 12/143,063, filed on Jun. 20, 2008 now U.S. Pat. No. 8,061,095, the entire contents of which are incorporated herein by reference.

STATEMENT RE: FEDERALLY SPONSORED RESEARCH/DEVELOPMENT

Not Applicable

BACKGROUND OF THE INVENTION

1. Technical Field

The present invention relates generally to a system and method for the building of walls for commercial, public, residential and other buildings, as well as similar structures.

2. Related Art

The construction of walls for buildings and other structures typically involves methods that provide for the formation of durable and fairly long-lasting structures. Preferred construction methods may also use cost-effective materials and processes that are reasonably easy to implement, thereby reducing the overall construction cost. In one example of a conventional method used to build walls for commercial and residential structures, a combination of cinder blocks, rebar tubes, and a concrete foundation are used to provide the building materials and framework for the wall construction. In a first step, a foundation for the wall is prepared by laying a slab of wet concrete over a selected area of ground. While the concrete is still wet, a number of the rebar tubes are inserted vertically into the foundation slab. The cinder blocks are lifted up over-top of the rebar tubes so the upper ends of the rebar tubes can be threaded through vertical holes formed in the cinder blocks. The cinder blocks are then lowered down along the rebar tubes to rest on, and even slightly within, the concrete foundation. Once a first course of blocks has been formed on the concrete foundation by these steps, second and subsequent courses can be formed by passing additional sets of cinder blocks over the rebar tubes to vertically stack them on top of the first course. Drying of the concrete foundation holds the rebar tubes and first course of cinder blocks in place. To fully stabilize the structure, wet mortar is typically poured into and through the holes in the cinder block courses, thereby sealing the structure upon drying.

However, a problem with such conventional methods is that the insertion of the rebar tubes, and even in some cases the laying of the first course of cinder blocks, typically must be performed before the concrete foundation has dried. If the insertion of the tubes is not completed before the concrete foundation has dried, or if the tubes or cinder blocks are discovered to have been placed incorrectly after the concrete has already dried, then the concrete slab has to be broken up, removed and re-laid in order to properly re-do the rebar tube insertion, which can be a very costly and time-intensive procedure. It can also be difficult to stabilize the re-bar tubes in the wet concrete for a duration sufficient to achieve placement of all of the tubes, increasing the likelihood of having to re-do the insertion step.

Yet another problem with such conventional wall construction methods is the cumbersome height of the rebar tubes typically required to build wall structures. Rebar tubes are selected according to the desired height of the wall structure, with very tall rebar tubes being selected for higher walls. Unfortunately, such high rebar tubes can make it difficult to lift the cinder blocks over the tops of the rebar tubes in order to form the wall. This can especially be true when placing cinder blocks while the concrete foundation is wet, as any "jolting" of the rebar while trying to place the blocks can dislodge the rebar from its proper position in the foundation. Also, lifting the cinder blocks to the tops of the rebar tubes increases the likelihood of breaking the cinder blocks, which are susceptible to fracturing and cracking if dropped with sufficient force.

A method proposed to compensate for these problems is the use of cinder blocks having openings formed in the front sides thereof, which allows positioning of the cinder blocks by sideways insertion of the blocks onto the rebar tube frame. However, these same openings can cause undesirable leaking of the mortar from the wall when attempting to seal the structure with mortar, making it difficult to achieve a fully sealed and stabilized structure.

Accordingly, there remains a need for a system and method for building a wall structure that allows for relatively easy construction thereof. There is also a need for a system and method that do not require the insertion of materials into a wet foundation to achieve a stable structure. There is further a need for a system and method that allows for stable construction without requiring the use of very long and cumbersome rebar tubes. There is also a need for methods that allow for the construction of wall structures substantially without requiring the use of mortar.

BRIEF SUMMARY OF THE INVENTION

The present invention is generally directed to a block building system for building a wall structure. The system includes a plurality of pre-formed blocks configured to be stacked vertically upon one another to form the wall structure. Each block has at least one frustum-shaped protrusion extending vertically upwards from a top surface of the block, a horizontal channel formed in a bottom surface of the block and extending at least partially into an interior of the block, and at least one aperture extending vertically through the interior of the block. The system also contains at least one base track having a C-shaped vertical cross-section, with the base track being sized and configured to engage the horizontal channel formed in the blocks.

The block building system also has a plurality of T-shaped reinforcement members having a horizontal base that is sized and configured to fit within the C-shaped cross-section of the base track, and a vertically extending rod portion that is sized and configured to pass through the at least one aperture formed in each block. The vertically extending rod portion has a plurality of first notches formed along a longitudinal axis thereof. A plurality of rod-shaped extension members are further provided as a part of the block building system, the extension members being sized and configured to pass through the at least one aperture formed in each block. Each extension member has a plurality of second notches that are configured to interlock with the plurality of first notches of each T-shaped reinforcement member. The block building system also has a plurality of securing members operative to secure the extension members to the T-shaped reinforcement members. One or more courses of blocks can be vertically stacked over the base track by passing the T-shaped reinforcement members and/or extension members through the apertures formed in the blocks, thereby forming the wall structure.

In one version, a method of building a wall structure with the block building system involves securing the base track to a foundation, and inserting the plurality of T-shaped reinforcement members into the base track. At least one base course of blocks is stacked over the base track and T-shaped reinforcement members by passing the vertically extending rod portion of the T-shaped reinforcement members through vertical apertures formed in each of the blocks. Extension members are secured to the T-shaped reinforcement members by interlocking the plurality of notches formed on each of the extension members and T-shaped reinforcement members together. At least one secondary course of blocks is stacked over the at least one base course of blocks by passing the extension members through the vertical apertures formed in each of the blocks. Optionally, additional extension members are secured to the extension members previously used by interlocking the plurality of notches formed on each extension member, and at least one additional course of blocks is stacked over the base and secondary courses of blocks by passing the additional extension members through the vertical apertures formed in each of the blocks. One or more of the above steps can also be repeated to form the final wall structure.

The present invention is best understood by reference to the following detailed description when read in conjunction with the accompanying drawings.

BRIEF DESCRIPTION OF THE DRAWINGS

These as well as other features of the present invention will become more apparent upon reference to the drawings wherein.

Common reference numerals are used throughout the drawings and detailed description to indicate like elements.

DETAILED DESCRIPTION OF THE INVENTION

Figure 1A:
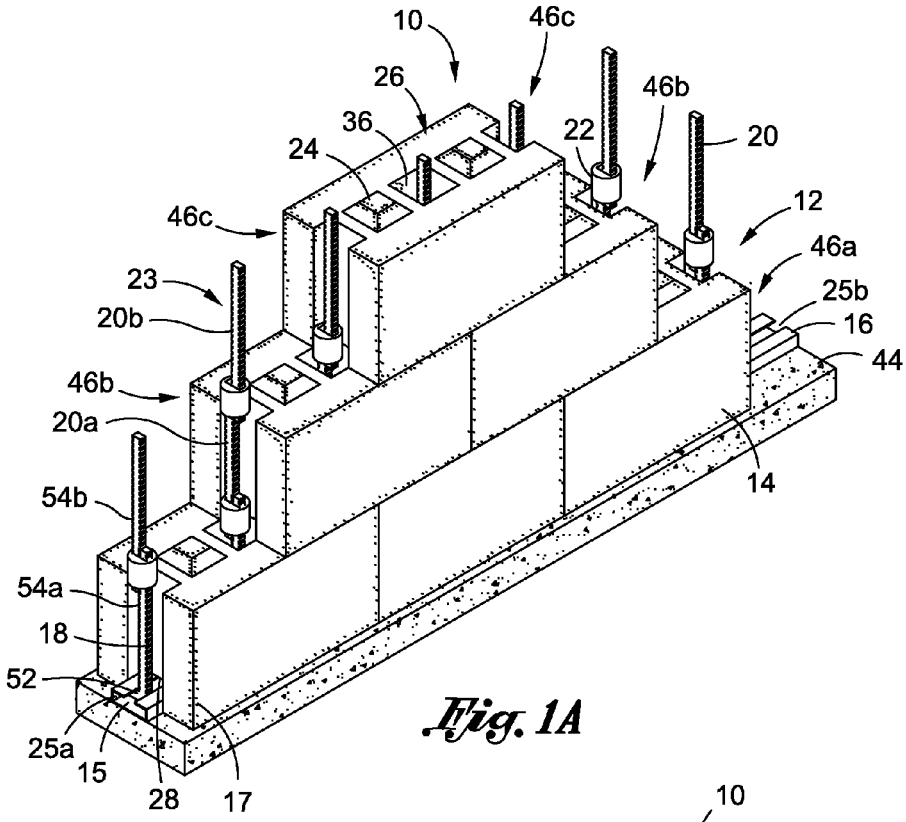
FIG. 1A is a partial schematic front view of an embodiment of a block building system for building a wall structure.

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

A block building system 12 and method for the building of wall structures 10 have been discovered that allow for improved ease of construction over conventional methods, and which can also optionally be employed without the application of extra mortar to seal the wall structure 10. The block building system 12 comprises a plurality of pre-formed blocks 14 that are configured to be stacked vertically upon one another to form the wall structure 10, as shown for example in FIGS. 1A-1B. The block building system 12 further comprises a base track 16, T-shaped reinforcement members 18, extension members 20 and securing members 22, that are utilized with the blocks 14 to form reinforced wall structures 10 suitable for use in the construction of buildings and other structures.

The plurality of pre-formed blocks 14 used in the system and method of wall construction are configured to allow for several advantages over conventional cinder blocks. By "pre-formed" it is meant that the blocks 14 are formed prior to their placement into the wall structure 10, as opposed to being formed in-situ. The blocks 14 can be formed of a variety of materials conventionally used for wall construction, such as cement, cinder block, clay, rock, adobe, brick, plastic, wood, metal, composites, and other suitable materials and combinations thereof.

Figure 2A:
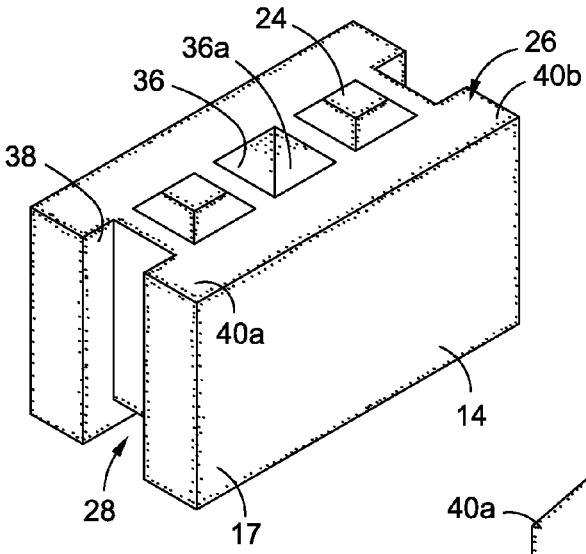
FIG. 2A is a schematic front view of an embodiment of a pre-formed block for a block building system.
Figure 2B:
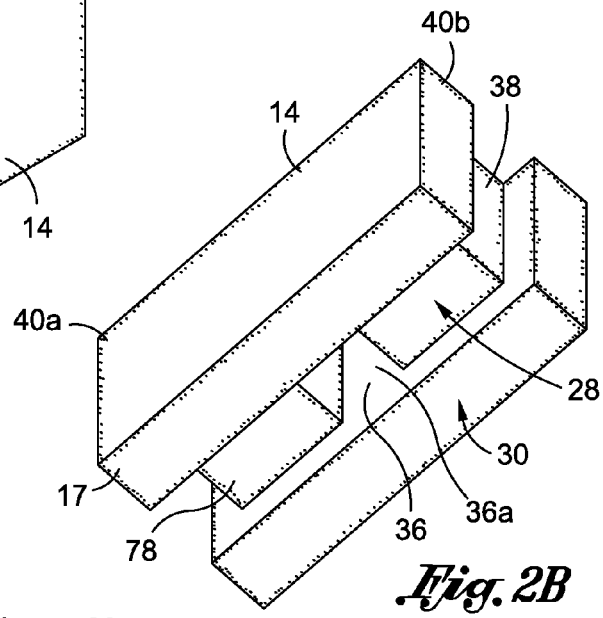
FIG. 2B is a schematic bottom view of the pre-formed block of FIG. 2A.
Figure 2C:
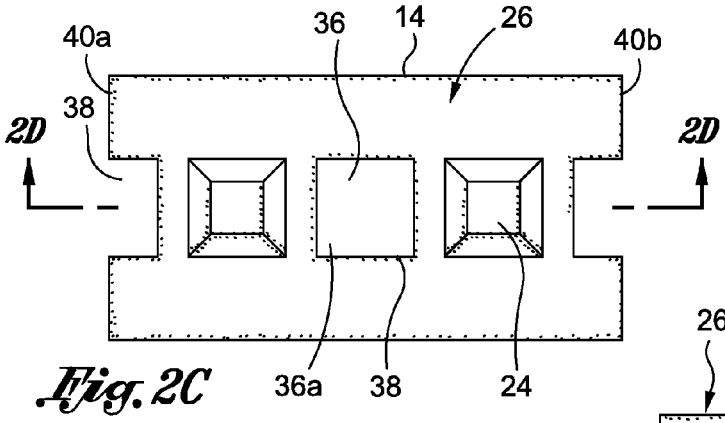
FIG. 2C is a schematic top view of the pre-formed block of FIGS. 2A-2B.
Figure 2D:
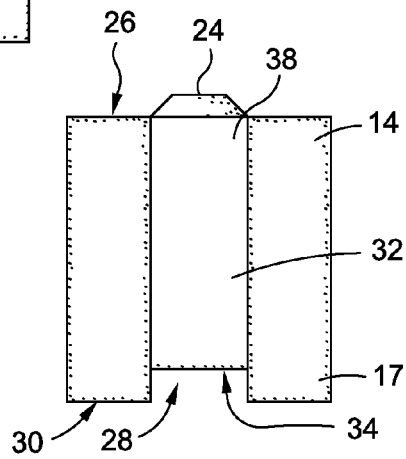
FIG. 2D is a schematic side view of the pre-formed block of FIGS. 2A-2C.

The blocks 14 each comprise at least one frustum-shaped protrusion 24 that extends vertically upwards from a top surface 26 of the block 14, as shown for example in FIGS. 2A and 2C-2D. The frustum-shaped protrusions 24 formed on the block surfaces 26 can comprise pyramidal frustum shapes (shown), conical frustum shapes (not shown), as well as other suitable shapes and combinations thereof. In the version shown, each block 14 comprises two pyramidal frustum-shaped protrusions 24 symmetrically located towards opposing ends 40*a*, 40*b* of each block 14. It should be understood that each block 14 can also alternatively comprise only a single, or alternatively multiple such protrusions in desired arrangements on the block surface 26.

Each block 14 further comprises at least one horizontal channel 28 that is formed in the bottom surface 30 of the block 14, and that extends at least partially into an interior 32 of the block 14. The blocks 14 containing the horizontal channel 28 in combination with the frustum-shaped protrusions 24 are advantageous in that they provide for a substantially self-registering stacking system, by virtue of the fact that the horizontal channels 28 are sized, shaped and configured to accommodate the frustum-shaped protrusions 24 of one or more blocks 14 vertically stacked therebeneath. That is, the frustum-shaped protrusions 24 of the blocks 14 at least partially fit within the horizontal channel 28 when stacked therebeneath, thereby allowing the vertically stacked blocks 14 to be substantially self-aligned on top of one another. The bottom horizontal channel 28 extends from a first end 40*a* of each block 14 to a longitudinally opposing second end 40*b*, and thus runs across substantially the entire bottom length of each block 14. The horizontal channel 28 of each block 14 is also sized, shaped and configured to fit over at least a portion of the base track 16 to allow for the formation of a base course of blocks thereon, as is described in more detail below. Furthermore, the horizontal channel 28 can also optionally be configured such that an upper surface 34 of the horizontal channel 28 is offset from the top surface 26 of another block stacked therebeneath, thereby allowing at least one of electrical conductors, plumbing tubes, and other household or industrial connectors to pass through the horizontal channel 28 and within the wall structure 10. In the version shown in FIG. 2*d*, the horizontal channel 28 comprises a vertical cross-section having a substantially rectangular shape, and extends less than about ¼ of the way into the interior 32 of the block 14.

The blocks 14 each also comprise at least one aperture 36 that extends vertically through the interior 32 of the block 14, as shown in FIGS. 2A-2C. The aperture 36 extends from the top surface 26 of the block 14, to the horizontal channel 28 on the bottom of the block 14 to form a passageway therebetween. In the version shown in FIGS. 2A-2C, the blocks 14 each comprise a single, central aperture 36*a* that extends vertically through the center of the block 14. However, it should be understood that the blocks 14 can alternatively comprise multiple vertically extending apertures 36 formed therein. The apertures 36 can comprise a horizontal cross-section that is square-shaped as shown, and can also comprise rectangular, circular and other horizontal cross-sectional shapes and combinations thereof.

In one version, vertical slots 38 are formed on the opposing ends 40*a*, 40*b* of each block 14. Similarly to the apertures 36, the vertical slots 38 extend from the top surface 26 of each block 14 to the horizontal channel 28 formed in the bottom of the block. As can be seen from FIG. 3C, slots 38 formed on the opposing ends 40*a*, 40*b* of each block 14 comprise a minor symmetry with one another, such that adjacent alignment of the blocks 14 results in the formation of a middle aperture 36*b* in between the adjacent blocks 14. The middle aperture 36*b* has dimensions defined by the adjacent slots 38, and as such may be selected to have a size, shape and configuration substantially similar to the central aperture 36*a* or other apertures 36 formed in the block 14.

Figure 1B:
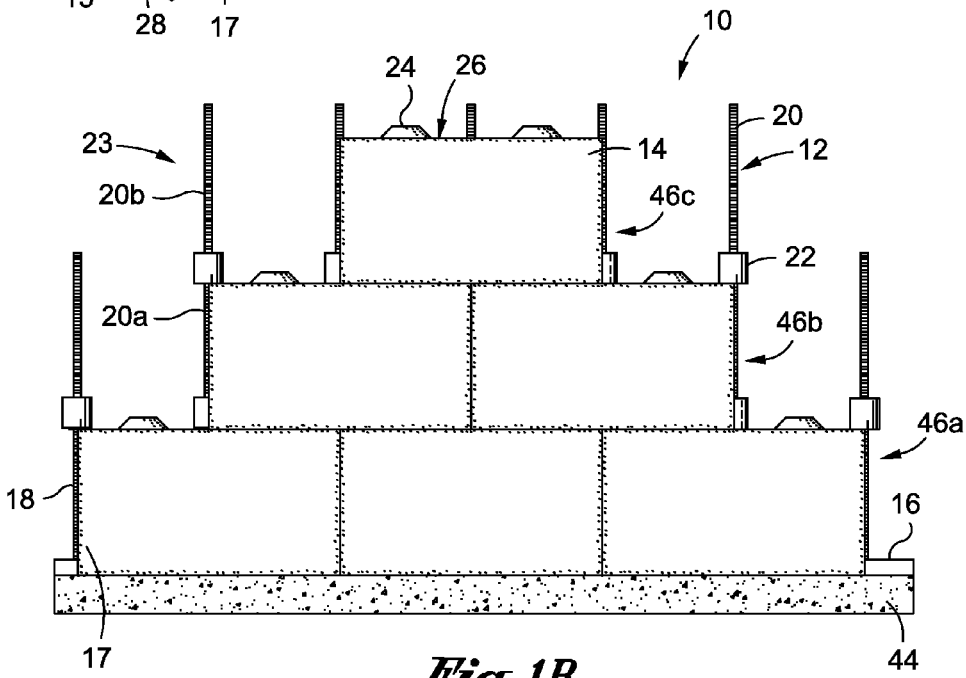
FIG. 1B is a partial schematic side view of the embodiment of the block building system for building the wall structure of FIG. 1A.
Figure 3A:
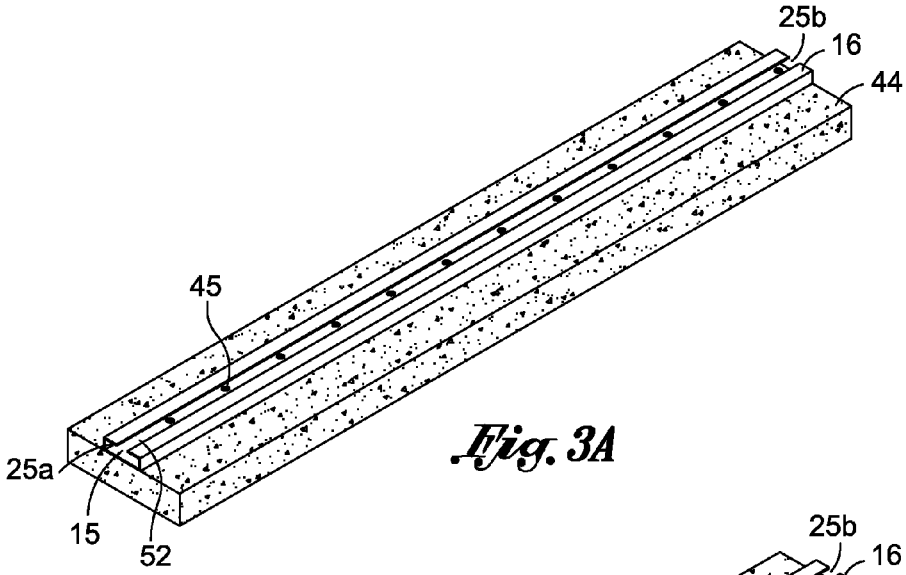
FIGS. 3A-3E are schematic front views of embodiments of components of a block building system for building a wall structure, the figures showing steps in the construction of the wall structure therewith.

The block building system 12 further comprises at least one base track 16 having a C-shaped vertical cross-section 15, as shown for example in FIGS. 1A and 3A. The base track 16 is configured to be secured to an underlying foundation 44, such as a concrete foundation, via concrete anchors 45 or other suitable attachment means. As such, the block building system 12 does not require wet concrete for installation thereof, but instead may be constructed upon a pre-formed and substantially dry foundation surface. The base track 16 is sized and configured to engage the horizontal channel 28 of each block 14. For example, in the version shown in FIG. 1A, the base track 16 and the horizontal channel 28 are sized and configured such that the horizontal channel 28 of each block 14 fits over the base track 16, such as by having a vertical cross-section that is sized to at least partially fit the C-shaped cross-section 15 of the base track 16 therein. The base track 16 further comprises a length that is sufficient to accommodate a plurality of blocks 14 in a bottom course 46*a* aligned thereon, thereby providing a base structure for the entire bottom course 46*a*. Multiple base tracks 16 may be serially or otherwise aligned together to provide for extension of the course 46*a*. The base track 16 also comprises an upper opening 52 formed longitudinally along the length thereof, and further comprises open track ends 25*a*, 25*b* that allow for the insertion of components therein.

The block building system 12 further comprises a plurality of T-shaped reinforcement members 18 that stabilize and reinforce the wall structure 10, as shown for example in FIGS. 3B and 4A-4E. The T-shaped reinforcement members 18 each comprise a horizontal base 48 that is sized and configured to fit within, and be held by, the C-shaped cross-section 15 of the base track 16. The T-shaped reinforcement members 18 also each comprise a vertically extending rod portion 50 that extends through the upper opening 52 of the base track 16 when the member 18 is inserted therein. The vertically extending rod portion 50 of each T-shaped member 18 is sized and configured to be capable of passing though the one or more apertures 36 formed in each of the blocks 14, and may even be sized and configured to pass through the apertures 36 of a plurality of courses 46*a*, 46*b*, 46*c* of vertically stacked blocks 14. Thus, multiple T-shaped reinforcement members 18 can be inserted into the base track 16 to provide a framework 23 for laying the bottom course 46*a* and subsequent courses of blocks 14.

The block building system 12 also comprises a plurality of rod-shaped extension members 20 that are capable of extending the reinforcement framework 23 initiated by the T-shaped reinforcement members 18 through further courses of blocks 46*b*, 46*c*, as shown in FIGS. 1A-1B, 3D-3E and 4A-4E. Each rod shaped extension member 20 is sized and configured to pass through the one or more apertures 36 of each block 14, and may even be configured to pass through the apertures 36 of a plurality of courses of vertically stacked blocks 14. The extension members 20 extend the height of the T-shaped reinforcement members 18 by attaching to and interlocking with the vertically extending rod portion 50 of the T-shaped reinforcement members 18. Additionally, the rod shaped extension members 20 are capable of attaching to and interlocking with each another to even further extend the framework 23.

Figure 4A:
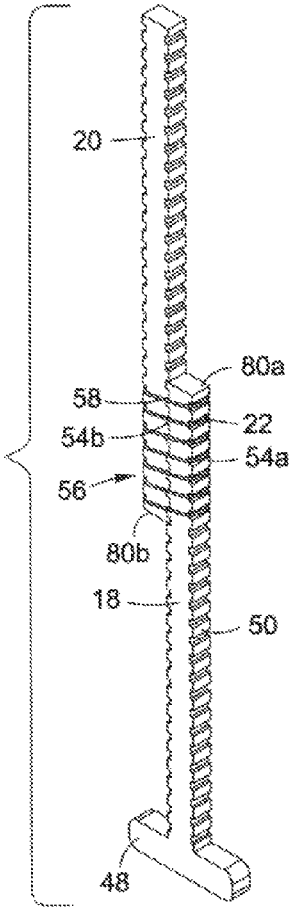
FIG. 4A is a schematic front view of an embodiment of a T-shaped reinforcement member and extension member secured together by a wire wrap.
Figure 4B:
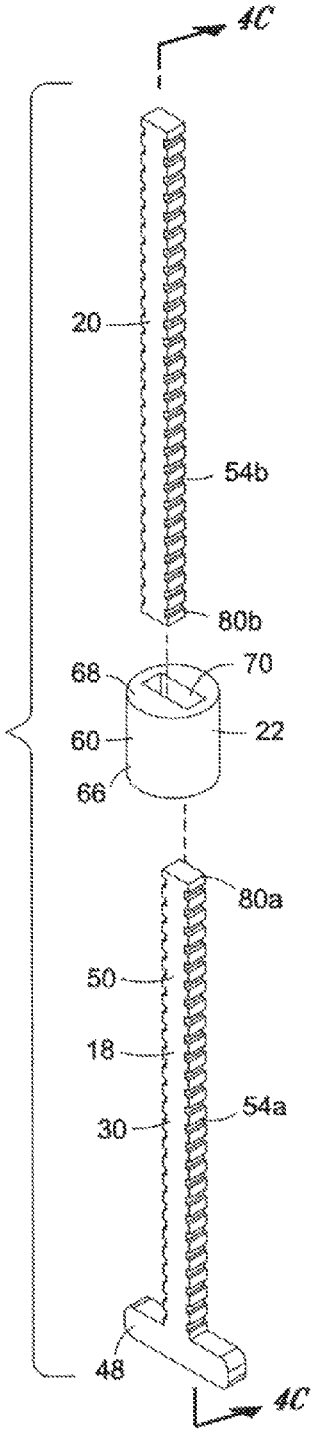
FIG. 4B is a schematic exploded front view of an embodiment of a T-shaped reinforcement member, extension member, and securing member comprising an annular collet.
Figure 4C:
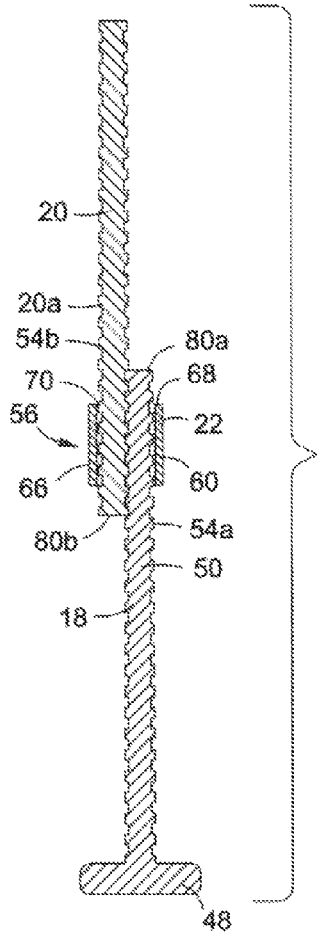
FIG. 4C is a schematic cross-sectional view of the embodiment of the T-shaped reinforcement member, extension member, and securing member comprising the annular collet of FIG. 4B, and showing the T-shaped reinforcement member and extension member in interlocking relation.

In the version shown in FIGS. 4A-4E, the vertically extending rod portions 50 of the T-shaped reinforcement members 18 comprise a plurality of first notches 54*a* formed thereon that are configured to interlock with a plurality of second notches 54*b* formed on the extension members 20 to engage the members 18, 20 to one another. The plurality of first notches 54*a* and plurality of second notches 54*b* preferably extend substantially along the entire longitudinal axis of the vertically extending rod portion 50 of each T-shaped reinforcement member 18 and each extension member 20, respectively. The members 18, 20 may be interlocked with one another at the ends 80*a*, 80*b* of the members 18, 20, as shown, or may be interlocked at different positions along their lengths, with an interlocking region 56 being formed where the first and second notches 54*a*, 54*b* interlock and overlap, as shown in FIGS. 4A and 4C. The notches 54*a*, 54*b* have complementary shapes and sizes selected to provide the desired interlocking arrangement, such as for example the square saw-tooth shape as shown in FIGS. 4A-4E.

Additionally, the notches of the extension members 20 can be configured to interlock with those of other extension members 20. For example, in the version shown in FIGS. 1A-1B and 4A-4E, the T-shaped reinforcement member 18 is attached to a first extension member 20*a* by interlocking the first and second plurality of notches 54*a*, 54*b*. A second extension member 20*b* is then added to extend the first extension member 20*a* by interlocking the plurality of notches 54*b* formed on each member 20, thereby further extending the framework 23. Subsequent extension members 20 can be further added, and with the number of members 20 used being selected according to the desired height of the final structure 10, the length of each of the T-shaped members 18 and extension members 20, as well as with regards to the desired wall reinforcement characteristics.

The block building system 12 further comprises a plurality of securing members 22 operative to secure the extension members 20 to the T-shaped reinforcement members 18 in an interlocking relation, as shown in FIGS. 4A-4E. Examples of suitable securing members 22 can include at least one of a wire wrap 58, an annular collet 60, a securing plate 62, as well as combinations thereof, as shown for example in FIGS. 4A-4E. The securing members 22 are also operative to secure extension members 20 to one another.

In the version shown in FIG. 4A, the securing member 22 comprises a wire wrap 58 that is wrapped about the plurality of first and second notches 54*a*, 54*b* in the interlocking region 56 to secure them together. The wire wrap 58 can comprise a strip of wire material having a pliability that allows it to be readily wrapped around the interlocking region 56. The wire wrap 58 can also optionally be used in combination with another securing member 22.

Yet another version is shown in FIGS. 4B-4C, which show an annular collet 60 comprising a cylindrical wall 66 and a cap portion 68 having a slot 70 formed therein. The annular collet 60 can be fitted about the interlocking region 56 by sliding the extension member 20 and/or T-shaped reinforcement member 18 through the slot 70 until the cylindrical wall 66 is about the interlocking region 56. The cylindrical wall 66 maintains the first and second notches 54*a*, 54*b* pressed together in an interlocking relation, and substantially does not allow the members to fall away from each other. FIG. 4C shows a sectional view of the annular collet 60 in position about the interlocking region 56. Optionally, the cap portion 68 can be configured to rest against an end 80*a*, 80*b* of the members 18, 20 when in interlocking position, to provide further reinforcement of the members 18, 20. Also optionally, the annular collet 60 can be used in combination with the wire wrap 58, such as by sliding the annular collet 60 over a pre-positioned wire wrap 58.

Figure 4D:
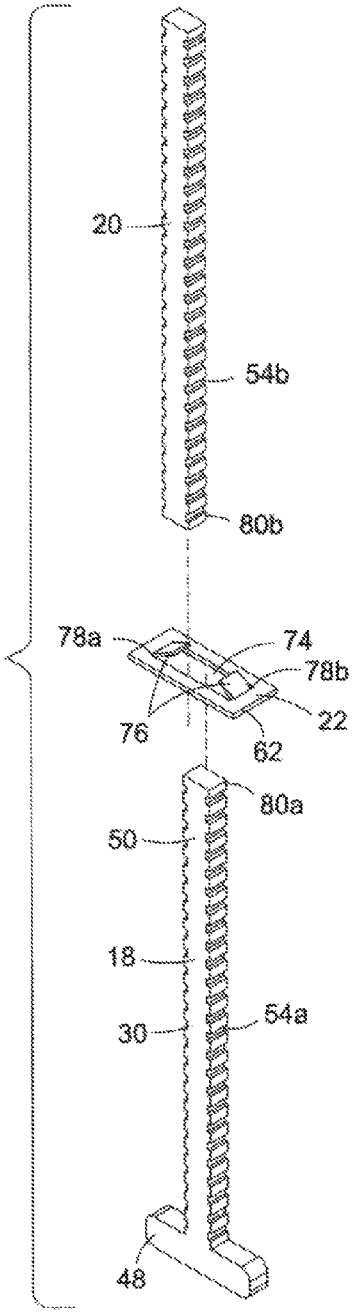
FIG. 4D is a schematic exploded front view of an embodiment of a T-shaped reinforcement member, extension member, and securing member comprising a securing plate.

In yet another version as shown in FIG. 4D, the securing member 22 comprises a securing plate 62. The securing plate 62 comprises a central opening 74 that is sized to fit the interlocking region 56 therethrough, and further comprises angled prongs 76 that extend inwardly from opposing sides 78*a*, 78*b* of the central opening 74. The angled prongs 76 are configured to engage notches on one or more of the T-shaped reinforcement member 18 and extension member 20, to maintain the members 18, 20 in interlocking relation with one another, as well as to resist vertical slippage of the members 18, 20. Similarly to the annular collet 60 described above, the securing plate 62 can be fitted about the interlocking region 56 by sliding the extension member 20 and/or T-shaped reinforcement member 18 through the opening 74 until the prongs 76 engage the notches at a desired part of the interlocking region 56. The securing plate 62 can be fitted onto the members with the prongs 76 angled upwardly, as shown, or can optionally be fitted with the prongs angled downwardly.

Figure 4E:
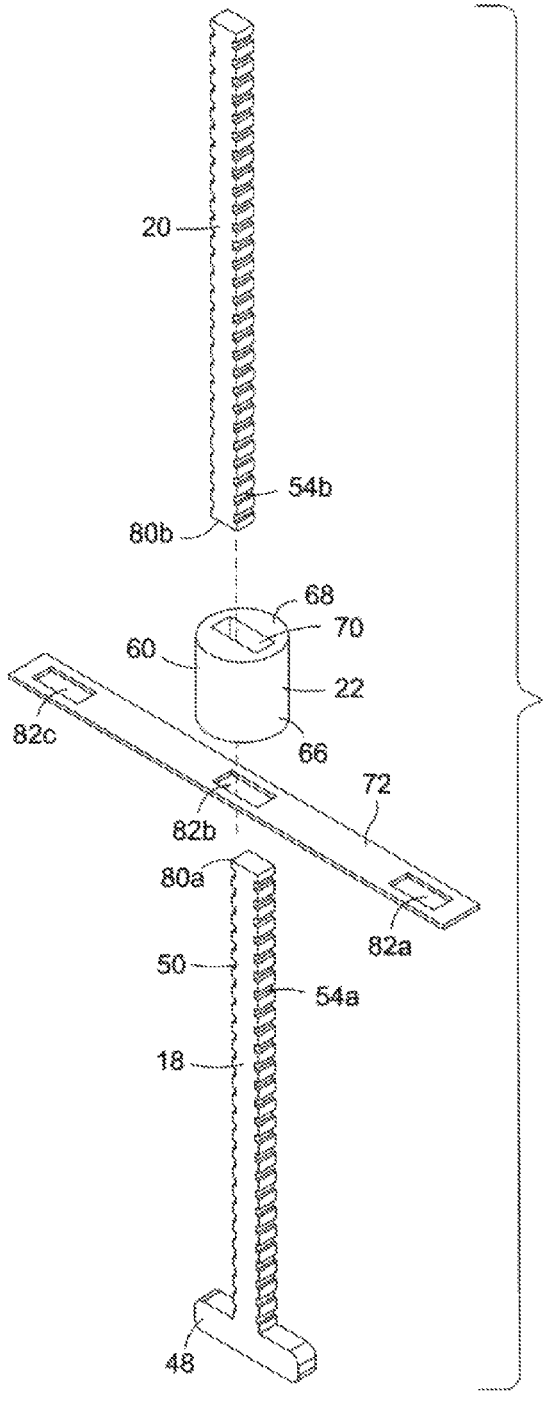
FIG. 4E is a schematic exploded front view of an embodiment of a T-shaped reinforcement member, extension member, securing member comprising an annular collet, and a reinforcement strip.

As shown in FIG. 4E, a reinforcement strip 72 can also optionally be provided as a part of the block building system 12 to further stabilize and reinforce the members 18, 20. The reinforcement strip 72 supports the lateral alignment of a plurality of the members 18, 20, and can also optionally act as a securing member 22 for the interlocking members 18, 20. The reinforcement strip 72 comprises a plurality of spaced-apart openings 82 along a longitudinal axis of the strip 72, such as at least three openings 82*a*, 82*b* and 82*c*, as in the version shown in FIG. 4E. The openings 82 are sized and configured to fit a region of the members 18, 20 therethrough, such as the interlocking regions 56 of the members 18, 20. The openings 82 are spaced apart across the horizontal length of the strip 72 such that they are capable of receiving a plurality of T-reinforcement member/extension members and also or alternatively a plurality of extension member/extension member interlocked combinations. As such, the distance between the openings 82 in the reinforcement strip 72 is selected in relation to a desired lateral spacing of the T-shaped reinforcement members 18 and extension members 20 inserted therethrough. The reinforcement strip 72 can be used by itself to provide lateral alignment and reinforcement, or optionally can be used with one or more additional securing members 22, such as the annular collet 60 as shown in FIG. 4E.

The block building system 12 of the instant invention thus provides substantial advantages over prior methods of wall construction. For example, the block building system 12 does not require the use of wet concrete during construction thereof, thus allowing wall structures 10 to be built within a desired time frame. The block building system 12 also does not require the use of long and cumbersome rebar tubes, and instead allows for the T-shaped reinforcement members to be extended to a desired height at will, and in-situ, via the one or more extension members 20. The building system 12 also allows for self-registering of courses of blocks 14, thereby reducing the amount of time required to properly align blocks 14 in each course. Household and industrial connectors such as electrical wiring can also be readily installed and concealed within the wall structures 10 by virtue of the horizontal channels 28 formed therein. Additionally, the building system 12 provides for the formation of durable and stable wall structures 10 that can optionally be constructed without the addition of mortar to the apertures 36 of the wall structure 10, and even without the addition of mortar at all, due to the stability of the wall structures 10 formed with the building system 12.

An exemplary embodiment of a method of constructing wall structures 10 with the building system 12 is described with reference to FIGS. 3A-3E. The building of wall structures 10 with the block building system 12 generally involves the steps of (a) securing the base track to a foundation, (b) inserting a plurality of the T-shaped reinforcement members into the base track, (c) stacking at least one course of blocks over the base track and T-shaped reinforcement members by passing the vertically extending rod portion of the T-shapes reinforcement members through the vertical apertures formed in each of the blocks, (d) securing extension members to the T-shaped reinforcement members by interlocking the plurality of notches formed on each of the extension members and T-shaped reinforcement members, (e) stacking at least one secondary course of blocks over the at least one first course of blocks, (f), optionally, securing additional extension members to the extension members of step (d) by interlocking the plurality of notched formed on each extension member, and stacking at least one additional course of blocks over the base and secondary course of blocks by passing the additional extension members through the vertical apertures formed in each of the blocks, and optionally repeating at least one of (a)-(f) to form the wall structure.

Figure 3B:
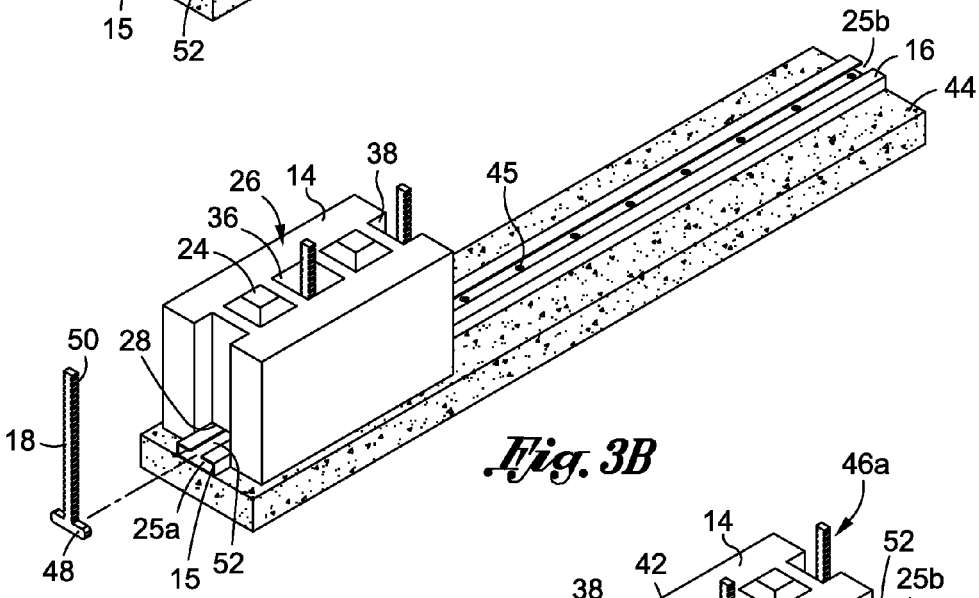

FIG. 3A shows an initial step in the building of the wall structure 10 with the block building system 12, which comprises securing the base track 16 to a pre-formed foundation 44, such as a concrete slab, via one or more concrete anchors 45 or other anchoring mechanisms. The base track 16 is secured to the foundation such that the opening 52 extending along the length of the track 16 is facing upwards. FIG. 3B shows the insertion of a plurality of T-shaped reinforcement members 18 into the secured base track 16 via the open ends 25*a*, 25*b*, with the members being slid along the track 16 to selected positions therein. The horizontal base section 48 of the T-shaped reinforcement member is held within the C-shaped base track 16, while the vertically extending rod portions 50 of each member 18 extends upwardly through the longitudinal opening 52 in the base track 16. The reinforcement members 18 are positioned along the track 16 with a spacing therebetween that corresponds to the spacing between adjacent apertures 36, as shown in FIG. 3B, or alternatively to a spacing between selected apertures 36 that are not necessarily all adjacent.

Figure 3C:
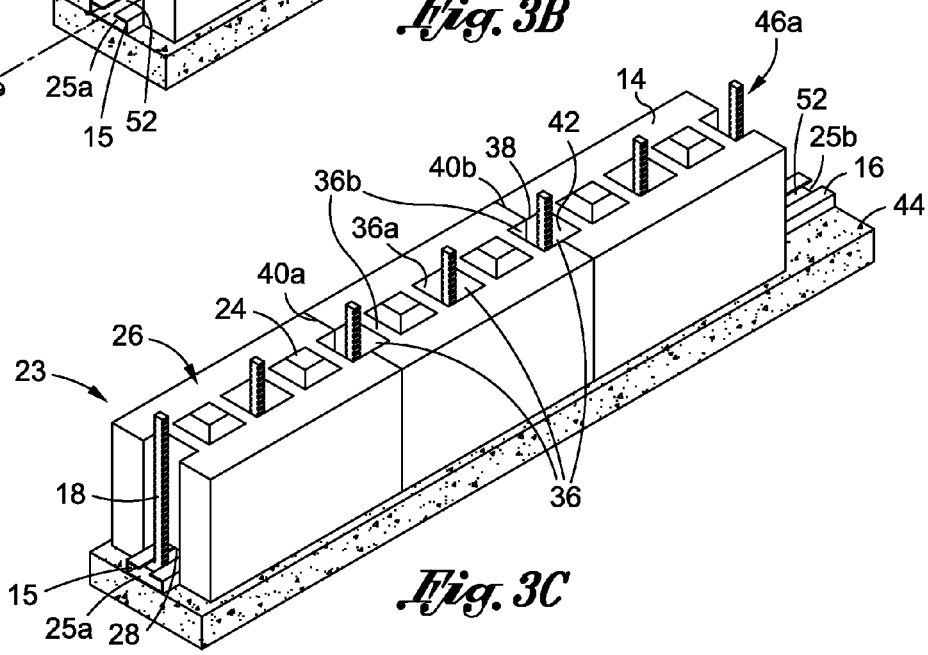

FIG. 3B further shows a first block 14 in a first course (e.g. a base course) stacked over the base track 16 and T-shaped reinforcement members 18 by passing the vertically extending rod portions 50 of the members 18 through the central aperture 36*a* formed in the block 14, as well as through slots 38 formed on the opposing ends 40*a*, 40*b* of the block 14. The horizontal channel 28 formed in the bottom of the block 14 is fitted over the C-shaped cross section 52 of the base track 16 to align the block 14 thereon. FIG. 3C shows subsequent blocks 14 being laid on the track 16 to form at least one base course 46*a* of blocks. The base track 16 thus serves not only to anchor the T-shaped reinforcement members 18, but also to align the base course of blocks 14. The subsequent blocks 14 are laid over the base track by passing the T-shaped reinforcement members though the central apertures 36*a* and slots 38, with adjacent slots between blocks 14 combining to form middle apertures 36*b*. Furthermore, while the version shown in FIG. 3C illustrates only a single base course 46*a* of blocks 14 placed over the T-shaped reinforcement members 18, it should be understood that a plurality of such courses 46*a* can also be fitted over the T-shaped reinforcement members 18. For example, the T-shaped reinforcement members 18 can have a length that is sufficient to allow them to pass through the apertures 36 of a plurality of vertically stacked blocks 14, and thereby accommodate a plurality of courses 46*a* stacked thereon.

Figure 3D:
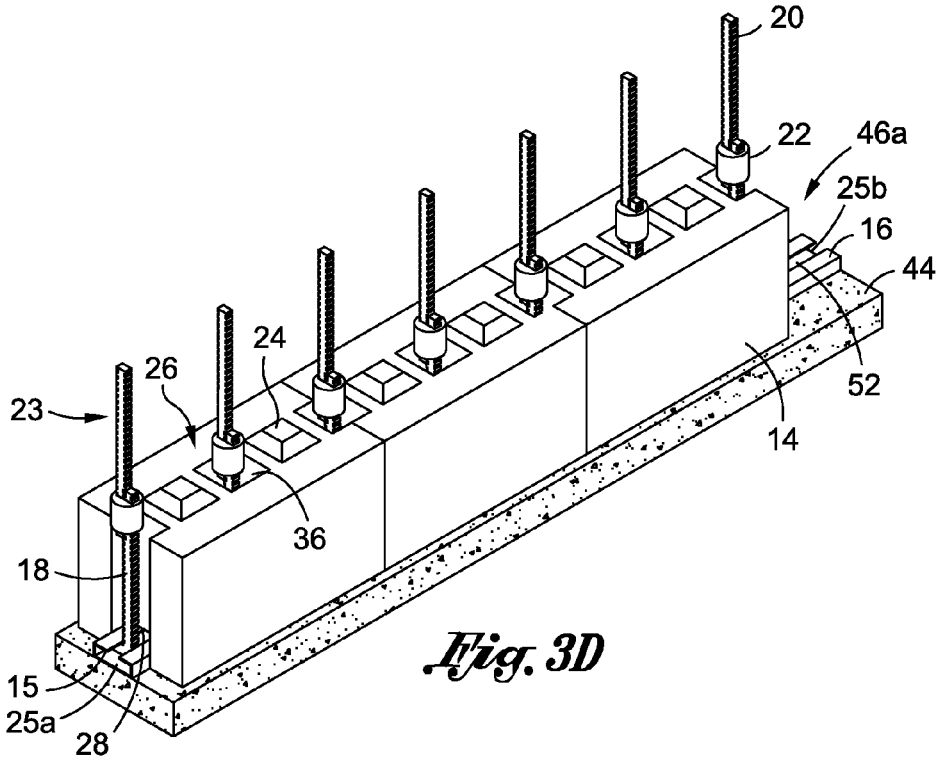

FIG. 3D shows the addition of extension members 20 to the T-shaped reinforcement members 18. The extension members 20 can be added to the ends of the reinforcement members 18, as shown, or alternatively can be attached in other configurations. The T-shaped reinforcement members 18 and extension members 20 are engaged to one another by interlocking the plurality of first and second notches 54*a*, 54*b* formed on the members 18, 20, and securing with securing members 22 positioned about the interlocking region 56. In the version shown in FIG. 3D, the securing member 22 comprises an annular collet 60 fixed about the interlocking region 56 of the members 18, 20. Two or more combinations of securing members 22 may also be used in combination with one another, and a reinforcement strip 72 may also be provided as a securing member 22 and/or in combination with other securing members 22.

Figure 3E:
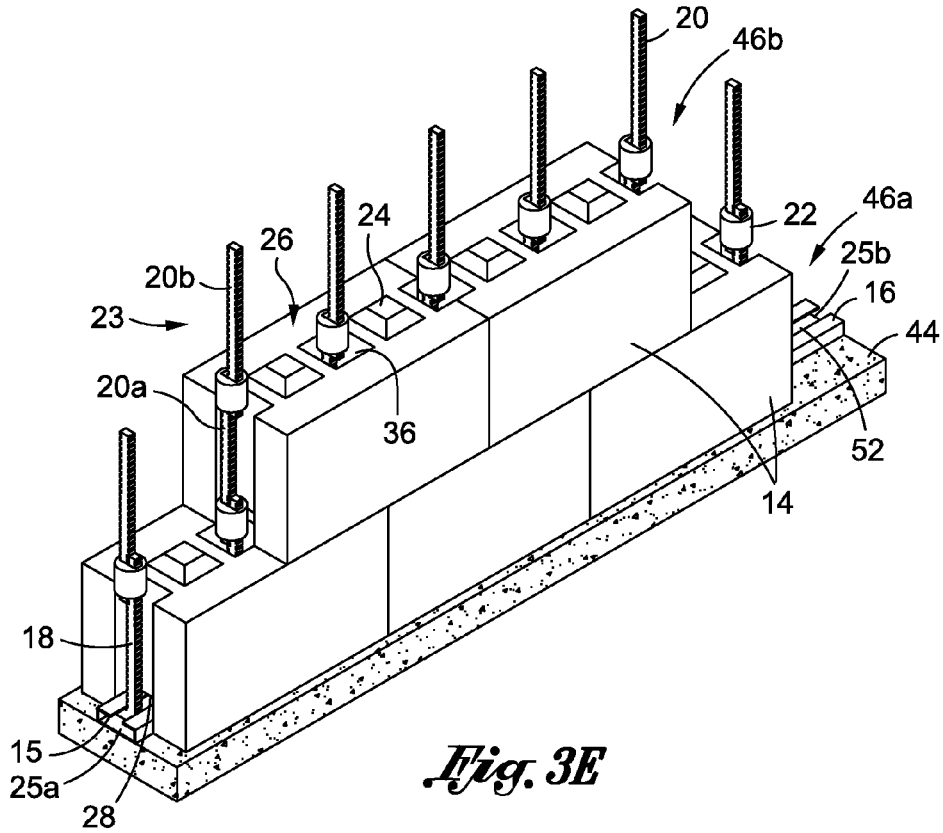

As shown in FIG. 3E, at least one secondary course 46*b* of blocks 14 is vertically stacked over the at least one base course 46*a* of blocks 14, with the second course 46*b* being substantially self-registering on top of the base course 46*a*. The self-registering of the courses 46*a*, 46*b* is provided by virtue of the presence of the frustum shaped protrusions 24 on the upper surfaces 26 of the blocks 14 in the first course 26*a*, which promote alignment of the courses 46*a*, 46*b*. The secondary course 46*b* is vertically stacked on top of the base course 46*a* by passing the extension members 20 through the apertures 36 and/or slots 38 in secondary course of blocks 14. The secondary course of blocks 14 can be stacked in an alternating pattern with respect to the base course 46*a*, such as with the central aperture 36*a* of a base block 14 being vertically aligned with the aperture 36*b* formed by adjoining slots 38, as shown in FIG. 3E. Other configurations and patterns of block courses can also be devised. The at least one secondary course 46*b* can comprise either a single course 46 stacked over the extension member, as shown in FIG. 3E, or can comprise multiple secondary courses, according to the length of the extension members 20 employed.

Optionally, one or more additional extension members 20*b* can be added to the initial extension members 20*a*, such as by interlocking and securing the plurality of notches 54*b* of each member 20*a*, 20*b* to one another with a securing member 22, as is also shown in FIG. 3E. Once the additional extension members 20*b* have been added, at least one additional course 46*c* of blocks 14 can be stacked over the base and secondary courses 46*a*, 46*b* by passing the additional extension members 20*b* through the vertical apertures 36 of the blocks 14. Similarly to the base and secondary courses 46*a*, 46*b*, the at least one additional course 46*c* can comprise only a single additional course or multiple additional courses 46*c*, according to the length of the additional extension members 20 provided and the desired wall structure configuration.

In some versions, a portion of at least one of the blocks 14, such as a lower corner 17 of the block, can be cut away to provide space for the insertion of utility boxes and other devices within the wall structure 10.

The steps described above can optionally be repeated, as needed, to form the final wall structure 10. For example, the addition of extension members 20, securing members 22 and courses of blocks 46 can optionally be repeated until a wall structure 10 having the desired dimensions is achieved. The steps of securing the base track 16, inserting the T-shaped reinforcement members 18 and securing extension members 20 thereto can also be repeated as needed to achieve the desired wall structure 10. A different extension member 20 can be used for each individual course of blocks 14 laid on the base course, or alternatively a plurality of courses can be positioned on single extension members 20. Furthermore, while mortar can optionally be added to seal the wall structure 10, the wall structure 10 constructed with the building system 12 is also sufficiently stable in the absence of mortar application.

Additional modifications and improvements of the present invention may also be apparent to those of ordinary skill in the art. Thus, the particular combination of components and steps described and illustrated herein is intended to represent only certain embodiments of the present invention, and is not intended to serve as limitations of alternative devices and methods within the spirit and scope of the invention. Along these lines, it should be understood that the order of steps for building the wall structure 10 as described can be switched as is suitable, for example the base track 16 could be anchored after portions of the wall structure 10 have been built, extension members 20 can be added to the T-shaped reinforcement members 18 before stacking courses of blocks 14 on the base track 16, etc. Also, the various components of the building system 12 may be made of materials other than those specifically described. Furthermore, the wall structure 10 may be in the form of a traditional wall, having a generally square or rectangular shape, or may optionally be in the form of a non-traditional shape, according to building parameters.

What is claimed is:

1. A block building system for building a wall structure, the system comprising:

(a) a plurality of pre-formed blocks configured to be stacked vertically upon one another to form the wall structure, each block comprising at least one frustum-shaped protrusion extending vertically upwards from a top surface of the block, a horizontal channel formed in a bottom surface of the block and extending at least partially into an interior of the block, and at least one aperture extending vertically through the interior of the block;

(b) at least one base track having a C-shaped vertical cross-section, the base track being sized and configured to engage the horizontal channel formed in the blocks;

(c) a plurality of T-shaped reinforcement members each comprising a horizontal base that is sized and configured to fit within the C-shaped cross-section of the base track, and further comprising a vertically extending rod portion that is sized and configured to pass through the at least one aperture formed in each block, the vertically extending rod portion comprise a plurality of first notches along a longitudinal axis thereof;

(d) a plurality of rod-shaped extension members sized and configured to pass through the at least one aperture formed in each block, each extension member comprising a plurality of second notches configured to interlock with the plurality of first notches of each T-shaped reinforcement member; and (e) a plurality of securing members operative to secure the extension members to the T-shaped reinforcement members, the securing member being a collet having a vertically oriented through hole, the vertically oriented through hole being sufficiently narrow to maintain the notch of the vertically extending rod portion of the T-shaped reinforcement member in an interlocked position with the notch of the extension member when both the vertically extending rod portion of the T-shaped reinforcement member and the extension member are axially offset from each other and received in the vertically oriented through hole of the collet.

2. The block building system of claim 1, wherein the frustum-shaped protrusion of each block is shaped, sized and configured such that the blocks are substantially self-registering upon vertical stacking of the blocks.

3. The block building system of claim 2, wherein the frustum-shaped protrusions comprise at least one of pyramidal and conical frustum shapes.

4. The block building system of claim 1, wherein each block comprises a central aperture that extends vertically through the center of the block.

5. The block building system of claim 1 wherein the blocks further comprise vertical slots formed on the opposing ends thereof, the vertical slots being configured to pass at least one of T-shaped reinforcement members and extension members therethrough.

6. The block building system of claim 1, wherein the horizontal channel of each block is sized and configured to fit over at least a portion of the base track.

7. The block building system of claim 1, wherein the base track comprises a length that is sufficient to accommodate a plurality of blocks in a course aligned thereon.

8. The block building system of claim 1, wherein the vertically extending rod portion of each T-shaped reinforcement member is sized and configured to pass through the apertures of a plurality of courses of vertically stacked blocks.

9. The block building system of claim 1, wherein each of the extension members are sized and configured to pass through the apertures of a plurality of courses of vertically stacked blocks.

10. The block building system of claim 1, wherein the plurality of first and second notches extend substantially along the entire length of each of the vertically extending rod portion of the T-shaped reinforcement member and the extension member, respectively.

11. The block building system of claim 1, wherein the collet comprises a cylindrically-shaped collar having a central opening sized to fit the interlocking region of the extension member and the T-shaped member therethrough.

12. The block building system of claim 1, wherein the securing plate comprises a central opening sized and configured to fit the interlocking region of the extension member and the T-shaped member therethrough, and wherein the plate comprises angled prongs extending inwardly from opposing sides of the central opening, the angle prongs being configured to engage notches on the T-shaped member and extension member.

13. The block building system of claim 1 further comprising a reinforcement strip to provide lateral reinforcement and alignment of the T-shaped members and extension members, the reinforcement strip having a plurality of openings spaced apart along the longitudinal axis of the strip, each of the openings being sized to fit an interlocking region of the extension member and T-shaped member therethrough.

14. The block building system of claim 1, wherein the system is configured to build a wall structure substantially without the addition of mortar.

15. The block building system of claim 1, wherein the horizontal channel of each block is configured such that an upper surface of the horizontal channel of each block is offset from the top surface of another block stacked therebeneath to allow at least one of electrical conductors, plumbing tubes, and household or industrial connectors to pass through the horizontal channel within the wall structure.

16. The block building system of claim 1 further comprising a reinforcement strip having a plurality of spaced apart openings along a longitudinal axis of the strip.

17. The block building system of claim 16 wherein the plurality of spaced apart openings comprises three spaced apart openings.

18. The block building system of claim 16 wherein each of the openings are sized and configured to fit the interlocking region of the T-shaped reinforcement member and the extension member.

* * * * *